US010563952B2

(12) United States Patent
Tedder et al.

(10) Patent No.: US 10,563,952 B2
(45) Date of Patent: Feb. 18, 2020

(54) HOLSTER LOCK

(71) Applicant: Tedder Industries, LLC, Post Falls, ID (US)

(72) Inventors: Thomas Tedder, Post Falls, ID (US); Jacob Shearer, Post Falls, ID (US); Taylor Vold, Valleyford, WA (US)

( * ) Notice: Subject to any disclaimer, the term of this patent is extended or adjusted under 35 U.S.C. 154(b) by 164 days.

(21) Appl. No.: 15/685,505

(22) Filed: Aug. 24, 2017

(65) Prior Publication Data

US 2018/0106576 A1 Apr. 19, 2018

Related U.S. Application Data

(60) Provisional application No. 62/407,675, filed on Oct. 13, 2016.

(51) Int. Cl.
*F41C 33/02* (2006.01)

(52) U.S. Cl.
CPC ..... *F41C 33/0263* (2013.01)

(58) Field of Classification Search
CPC ..... F41C 33/0263
USPC ..... 224/243, 244, 198, 193
See application file for complete search history.

(56) References Cited

U.S. PATENT DOCUMENTS

| | | | | | |
|---|---|---|---|---|---|
| 3,866,811 | A * | 2/1975 | Hamby | F41C 33/0209 | 224/244 |
| 3,910,469 | A * | 10/1975 | Baldocchi | F41C 33/0245 | 224/198 |
| 5,449,103 | A * | 9/1995 | Tilley | F41A 17/063 | 224/244 |
| 6,634,527 | B2 * | 10/2003 | Liu | F41C 33/0209 | 224/198 |
| RE44,428 | E * | 8/2013 | Spielberger | F41C 33/0263 | 224/238 |
| 8,720,754 | B2 * | 5/2014 | Kirsch | F41C 33/0236 | 224/198 |
| 2010/0252591 | A1 * | 10/2010 | Lu | F41C 33/0263 | 224/243 |

FOREIGN PATENT DOCUMENTS

| | | | | |
|---|---|---|---|---|
| EP | 1054229 A | * | 11/2000 | F41C 33/02 |
| WO | WO20100064268 A1 | * | 6/2010 | F41C 33/02 |

* cited by examiner

*Primary Examiner* — Nathan J Newhouse
*Assistant Examiner* — Lester L Vanterpool
(74) *Attorney, Agent, or Firm* — Timberline Patent Law Group

(57) ABSTRACT

Representative implementations of devices and techniques provide a holster lock assembly, which may be used with a carrier or a holster for an implement in a variety of configurations. The holster lock is arranged to be attached to the holster for temporarily and safely locking the implement within the holster, while making the implement easily accessible to the user. The holster lock includes an actuator arm and a locking post. The locking post is arranged to capture a portion of the implement or release the portion of the implement, based on a position of the actuator arm.

18 Claims, 12 Drawing Sheets

HOLSTER LOCK

PRIORITY CLAIM AND CROSS-REFERENCE TO RELATED APPLICATION

This application claims the benefit under 35 U.S.C. § 119(e)(1) of U.S. Provisional Application No. 62/407,675, filed Oct. 13, 2016, which is hereby incorporated by reference in its entirety.

BACKGROUND

Implements, such as tools, weapons, and the like, may be encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished.

In the case of a handgun, the holster should reasonably protect the handgun and the user, and should be convenient to the user for ready use. Accordingly, the holster should retain the handgun until it is to be used, but allow the user to draw the handgun for use without undue effort or difficulty. The holster should be rigid and stable enough to allow the handgun to be repeatedly drawn and reholstered, usually with the same hand. Additionally, the holster should provide sufficient assurance that the handgun will remain in the holster until intentionally withdrawn, including remaining in the holster while the user is running, jumping, or otherwise engaged in a vigorous activity.

A strap or a flap can be provided on some holsters to close off a portion of the holster opening, trapping the handgun within the holster. The strap can provide a measure of assurance that the handgun will remain within the holster while the strap is secured. However, the user must disengage the strap to ready the handgun for use. With the strap in the disengaged position, the handgun can potentially fall out of the holster if the user begins running or jumping, etc. before re-securing the strap. Further, the handgun could be susceptible to access by another person while the strap is unsecured, for example if the other person is grappling with the user.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions of components shown in the illustrations of the figures are for example and ease of discussion, and other shapes and or dimensions may be used and remain within the scope of the disclosure, unless specified otherwise.

FIG. 1A shows the holster lock in an extended configuration and FIG. 1B shows the holster lock in a retracted configuration.

FIG. 2A shows the holster lock in an extended configuration and FIG. 2B shows the holster lock in a retracted configuration.

FIGS. 5A, 5C, and 5D show a perspective view and FIG. 5B shows a side view according to various embodiments.

FIGS. 6A and 6C show the holster lock in an extended configuration, and FIGS. 6B and 6D show the holster lock in a retracted configuration.

DETAILED DESCRIPTION

Overview

Figure 1A:
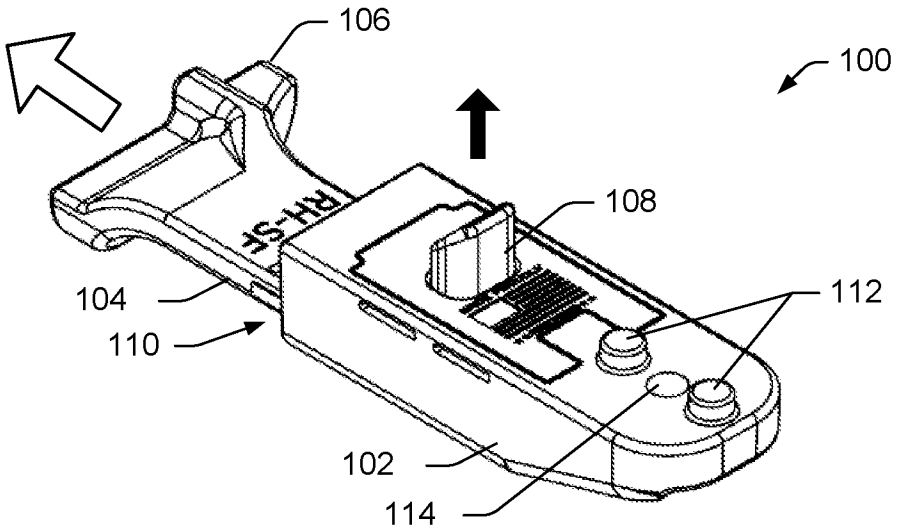
FIGS. 1A and 1B show two views of an example holster lock, according to an embodiment.
Figure 1B:
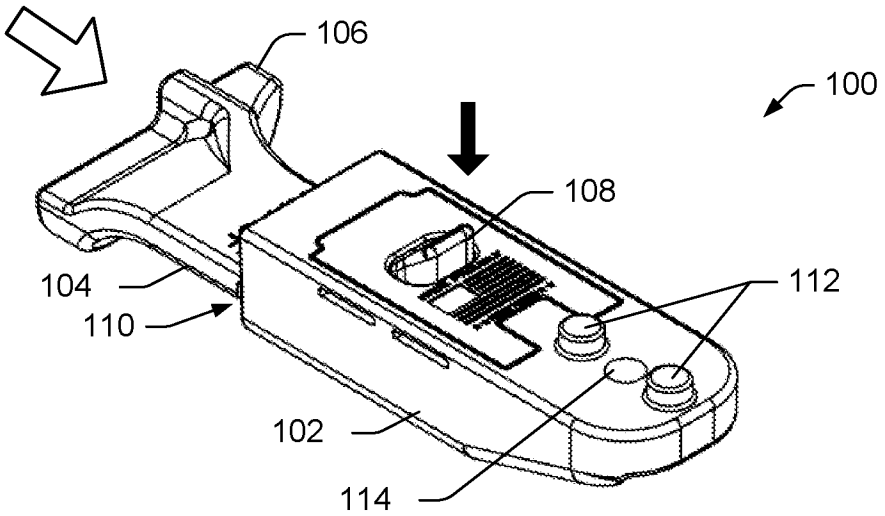
Figure 2A:
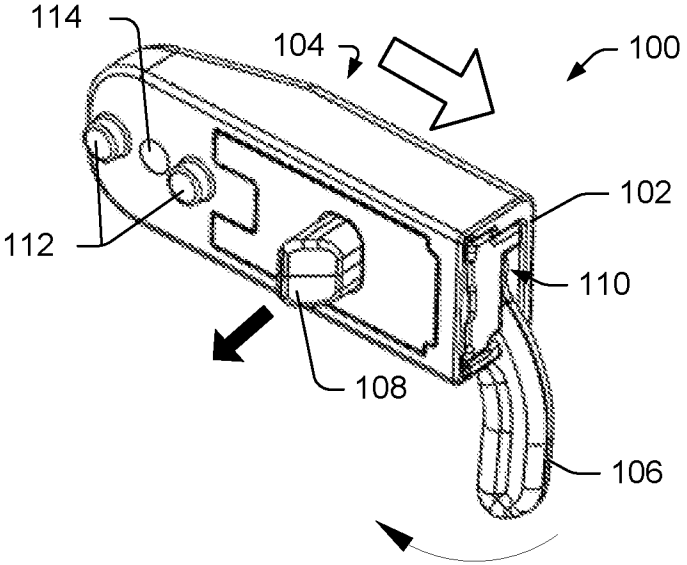
FIGS. 2A and 2B show two views of another example holster lock, according to an embodiment.
Figure 2B:
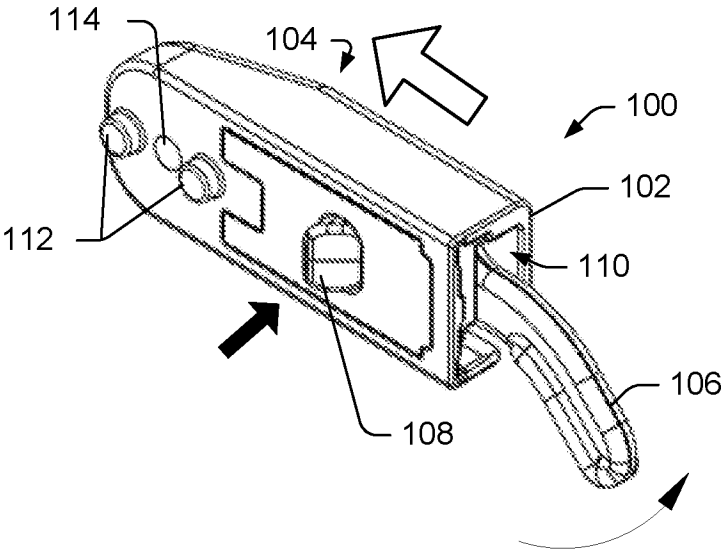
Figure 3B:
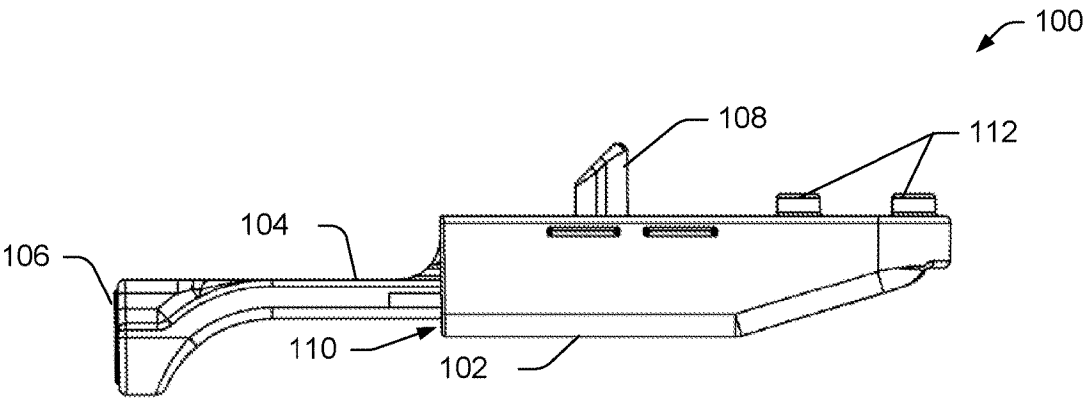
FIGS. 3A-3D include four views of an example holster lock, according to an embodiment. Included are a front view at FIG. 3A, a side view at FIG. 3B, a back view at FIG. 3C, and a top view at FIG. 3D.
Figure 3D:
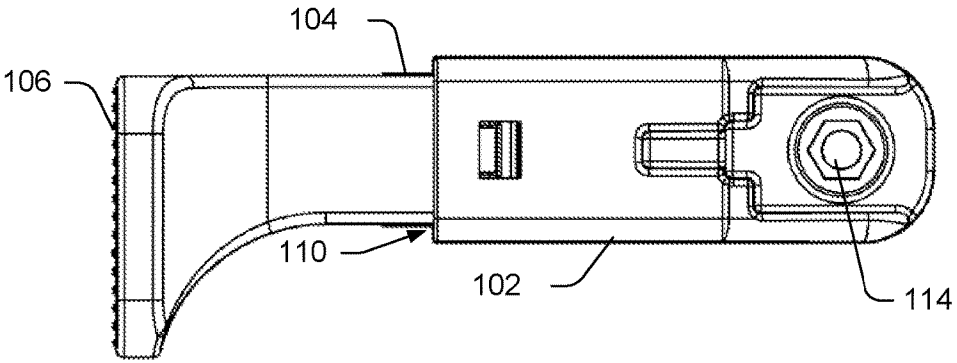
Figure 3A:
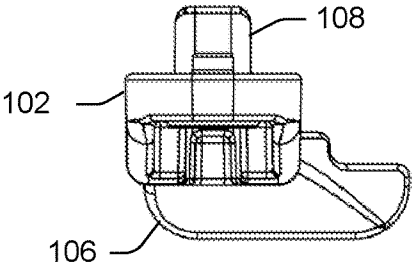
Figure 3C:
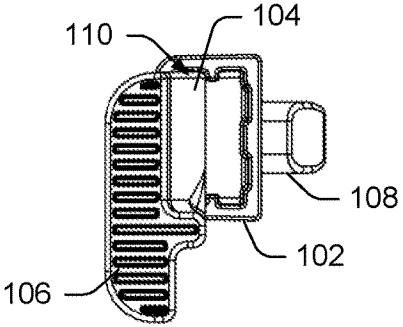
Figure 4B:
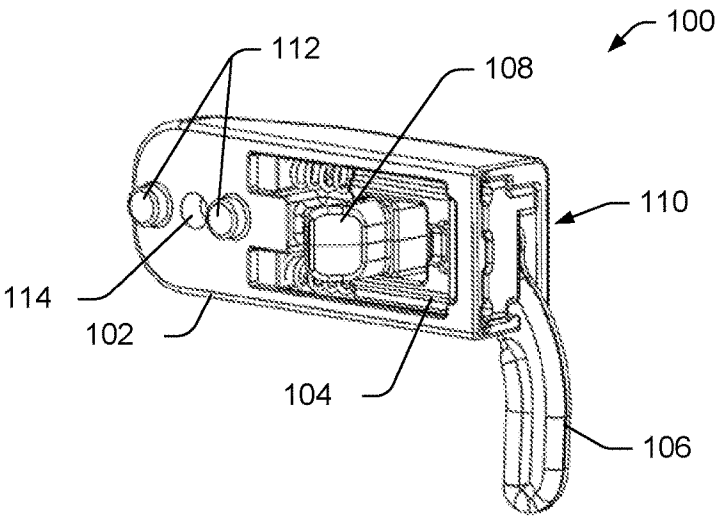
FIGS. 4A-4C include three views of example holster locks, according to various embodiments, showing some interior details.
Figure 4C:
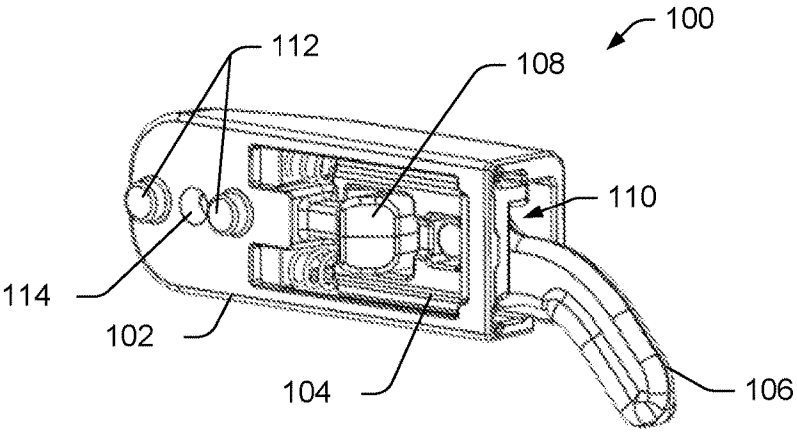
Figure 4A:
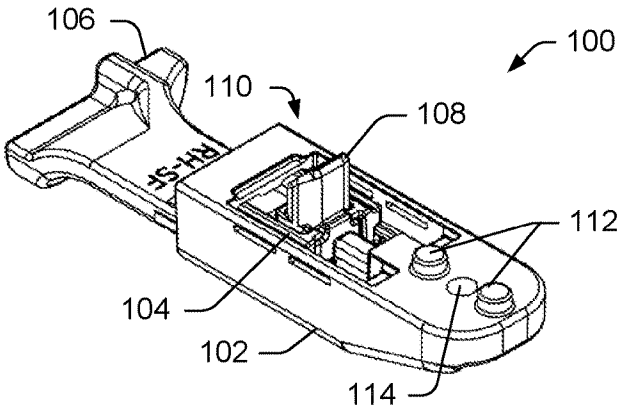
Figure 5A:
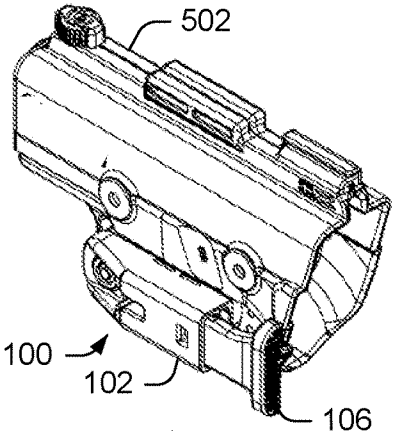
FIGS. 5A-5D include four views of an example holster lock mounted to an example holster, according to various embodiments.
Figure 5B:
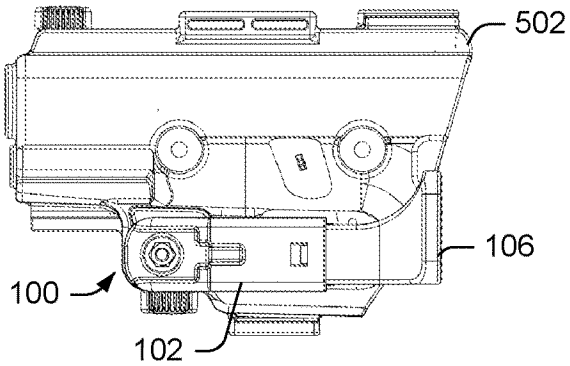
Figure 5C:
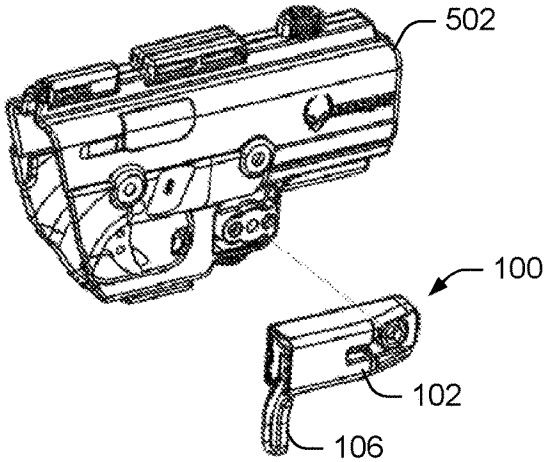
Figure 5D:
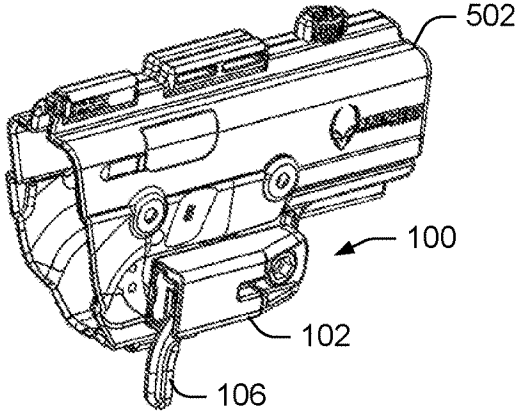

Representative implementations of devices and techniques provide a holster lock assembly, which may be used with a carrier or a holster for an implement (such as a handgun holster, for example), in a variety of configurations. The holster lock is a self-contained assembly, arranged to be attached to the holster (or another carrier) for temporarily and safely locking the implement within the holster, while making the implement easily accessible to the user. For example, the holster lock may be mounted to the holster in such a way as to trap or capture a portion of the implement, and thus to retain the implement within the holster until intentionally released. Once intentionally released, the implement may be removed from the holster by a user. In an example, the implement comprises a firearm and the carrier or holster comprises a firearm holster.

In various implementations, a user can mount the holster lock to a holster, so that the user can stow the implement within the holster and set the holster lock to retain the holster until released. In many embodiments, the implement is automatically locked within the holster once the implement is placed within. For example, the user can holster the implement as normal, and when doing so, the implement is locked within the holster. Unless the holster lock is released, the user is unable to withdraw the implement from the holster. However, the user can easily and quickly withdraw the implement from the holster once the user intentionally releases the holster lock.

In an implementation, the holster lock includes a housing configured to be coupled to a carrier, an actuator arm disposed partly within a cavity of the housing and free to move within the cavity along a longitudinal axis of the housing, and a locking post disposed partly within the housing and moveably coupled to the actuator arm. In various examples, the locking post is arranged to extend from the housing when the actuator arm is activated in a first configuration and to retract into the housing when the actuator arm is activated in a second configuration. The locking post is configured to retain an implement within the carrier when extended from the housing.

Techniques and devices are discussed with reference to example firearm holsters illustrated in the figures. However, this is not intended to be limiting, and is for ease of discussion and illustrative convenience. The techniques and devices discussed may be applied to any of various cases, case designs, combinations, and the like, (e.g., enclosures, sheaths, covers, cases, carriers, etc.) for encasing tools, weapons, or other implements and accessories, and remain within the scope of the disclosure.

Implementations are explained in more detail below using a plurality of examples. Although various implementations and examples are discussed here and below, further implementations and examples may be possible by combining the features and elements of individual implementations and examples.

Example Embodiments

An example holster lock 100 is shown in FIGS. 1A-12B, according to various implementations. As shown in FIGS. 1A-4C an example holster lock 100 includes a housing 102, an actuator arm 104, and a locking post 108. For instance, the movement of the locking post 108 relative to the housing 102 can be primarily controlled by moving the actuator arm 104. In some implementations, the holster lock 100 also includes an actuator button 106, which may be integral to or coupled to the actuator arm 104, or which may be coupled to another portion of the holster lock 100 and still activate the actuator arm 104. The actuator button 106 may be used to move the actuator arm 104, thereby controlling the locking post 108. In various embodiments, the actuator button 106 comprises a button, a lever, a switch, or the like. In alternate implementations, an example holster lock 100 may include fewer or more components, or may include alternate components to those shown, and remain within the scope of this disclosure.

As shown in FIGS. 5A-6D, the holster lock 100 may be used with a carrier 502 (e.g., externally mounted to the carrier 502), such as a holster for an implement (e.g., a handgun, a weapon, a tool, etc.), to retain the implement within the carrier 502 until intentionally released. For example, the housing 102 is arranged to be temporarily or permanently attached to an implement holster such as the carrier 502 shown in FIGS. 5A-6D, or with various other types of carriers 502, as well as with other carriers, holsters, cases, sheaths, covers, holders, enclosures, containers, and the like. For this disclosure, the use of the terms "carrier" or "holster" are interchangeable, and also apply to these various other covers, cases, enclosures, etc. Further, the shape of the holster lock 100 may vary to accommodate the various carriers 502, as well as to accommodate various applications.

The holster lock 100 may include various mounting features (e.g., 112, 114) for mounting the holster lock 100 to a holster 502. In some embodiments, the holster lock 100 may be customized with unique mounting features (e.g., 112, 114), based on the holster 502 to be coupled to. In other embodiments, the holster lock 100 may include generic mounting features that will work with a variety of holsters 502.

For instance, referring to FIGS. 1A-4C, in various implementations, the holster lock 100 includes one or more mounting portions 112 integral to or coupled to the housing 102. The mounting portion(s) 112 are configured to temporarily or permanently couple the lock assembly 100 to an outer surface of the holster 502, by interfacing with a portion of the surface of the holster 502. In one example, as shown in FIGS. 1A-4C, the mounting portions 112 comprise protrusions on one or more surfaces of the housing 102. The protrusions 112 (or the like) can be inserted into openings or depressions on the surface of the holster 502, to stabilize the housing 102 with respect to the holster 502, while one or more fasteners are used with holes 114 to fasten the housing 102 to the holster 502. In other examples, other mounting options are also possible (e.g., a rail mount, slide, or snap fitting, etc.).

Figure 6A:
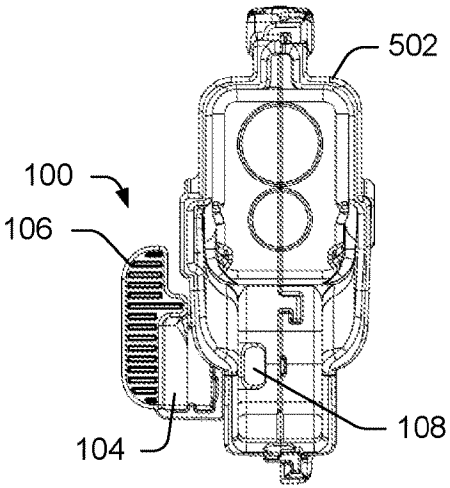
FIGS. 6A-6D include four views of an example holster lock attached to an example holster, according to various embodiments.
Figure 6B:
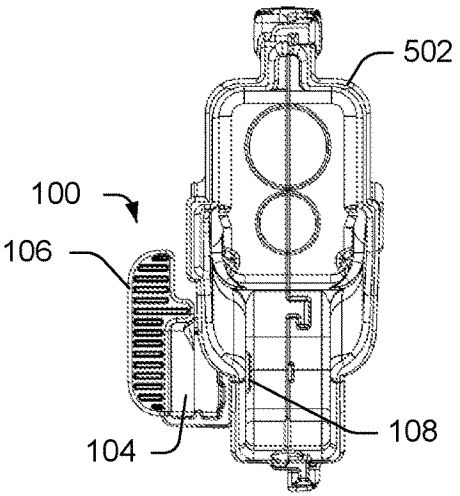
Figure 6C:
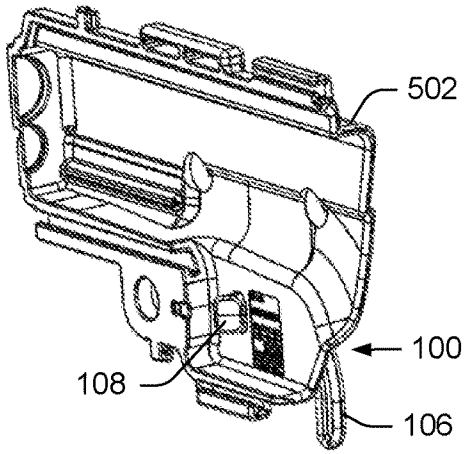

In an implementation, as shown in FIGS. 6A and 6C, the locking post 108 is arranged to extend through an opening in the surface of the holster 502 and into an interior of the holster 502 when the lock assembly 100 is coupled to the holster 502 and the actuator arm 104 is moved into a first configuration. In this position, the locking post 108 extends into the interior of the holster 502 a distance to catch and trap a portion of the implement (such as a trigger guard). For instance, in an example, the first configuration comprises the actuator arm 104 extended in a direction away from the locking post 108, or extended in a direction out from the housing 102.

As mentioned, in various embodiments, the locking post 108 is configured to engage and to trap a portion of an implement (not shown), to retain the implement within the implement holster 502, when the locking post 108 is extended from the housing 102. For instance, depending on the mounting location of the housing 102 on the holster 502, the locking post 108 may trap a portion of the trigger guard of the implement when the post 108 is extended.

Figure 6D:
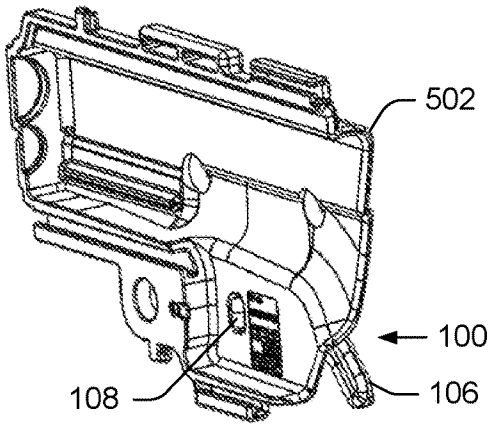
Figure 7A:
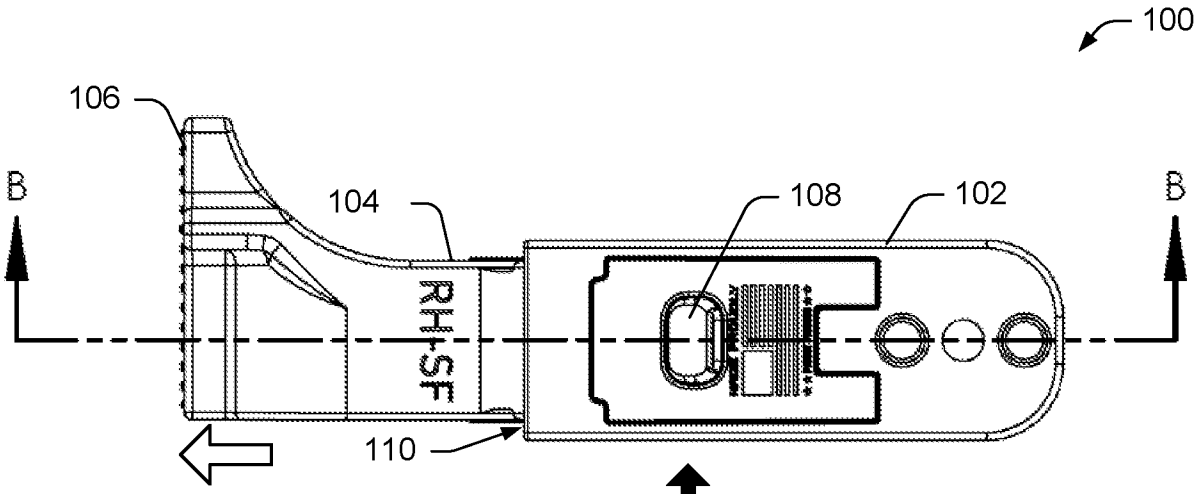
FIGS. 7A and 7B include two views of an example holster lock, according to an embodiment. Illustrated are: a bottom view at FIG. 7A and a cross-section view (shown cut-away along the section line B-B) at FIG. 7B.
Figure 7B:
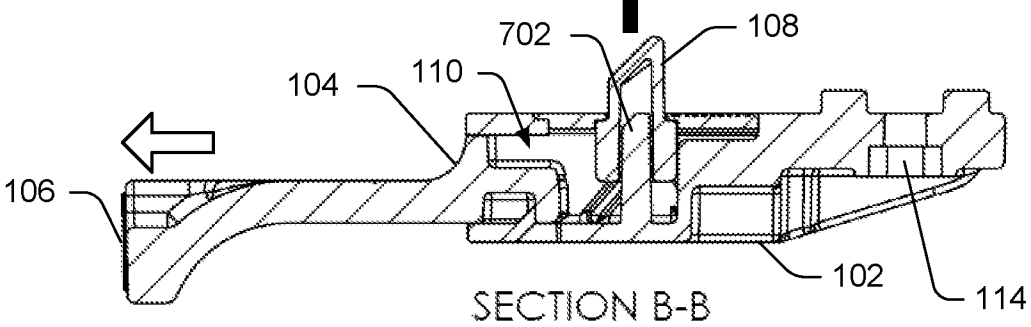
Figure 8A:
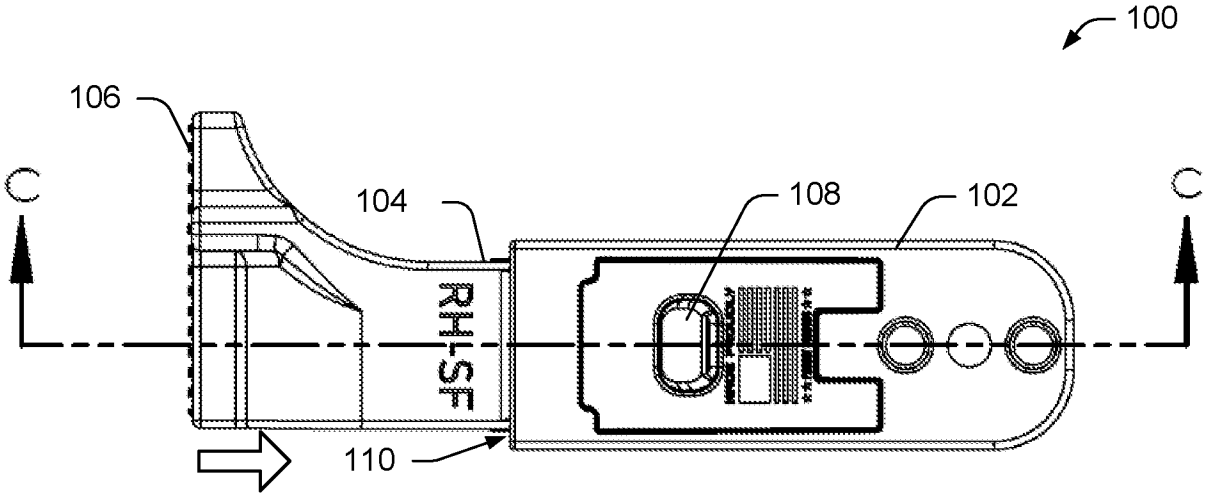
FIGS. 8A and 8B include two views of an example holster lock, according to an embodiment. Illustrated are: a bottom view at FIG. 8A and a cross-section view (shown cut-away along the section line C-C) at FIG. 8B.
Figure 8B:
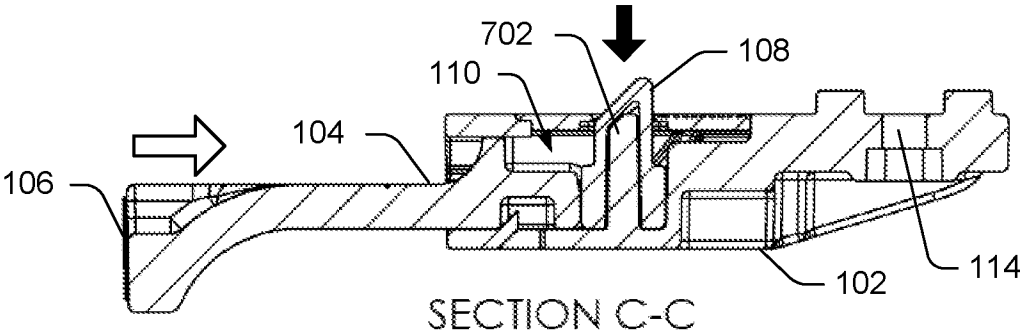

To release the implement from the holster 502, the locking post 108 is retracted into the housing 102 (as shown in FIGS. 6B and 6D) by moving the actuator arm 104 into a second configuration (e.g., a retracted configuration). With the locking post 108 retracted, the implement may be withdrawn from the holster 502. For instance, in an implementation as shown at FIG. 6B, the user may press on the button 106 to move the actuator arm 104 into the housing 102, which retracts the locking post 108 into the housing 102 and releases the implement, allowing the implement to be withdrawn from the holster 502. In another implementation as shown at FIG. 6D, the user may pull on the button 106 (e.g., lever) to move the actuator arm 104 into the housing 102, which retracts the locking post 108 into the housing 102.

In an embodiment, putting an implement into the holster 502 pushes on the locking post 108, retracting the locking post 108 into the housing. In some embodiments, the locking post 108 may have a beveled portion to facilitate the implement pushing the locking post 108. For example, the locking post 108 is retracted into the housing 102 while the implement is being inserted into the holster 502, and when the implement is fully within the holster 502, the locking post 108 returns to an extended state, trapping a portion of the implement. This captures the implement within the holster 502, retaining the implement until it is intentionally released from the holster 502.

As shown in FIGS. 7A-11, in various implementations, the housing 102 includes an interior cavity 110. In the implementations, the actuator arm 104 is disposed partly or fully within the cavity 110 within the housing 102. The actuator arm 104 is able to travel fore and aft within the cavity 110, along an axis running the length of the housing 102 (i.e., a longitudinal axis of the housing). In an embodiment, one or more rails 1002 (as shown in FIG. 10B) are disposed within the cavity, arranged parallel to the longitudinal axis of the housing, and the actuator arm 104 is slideably coupled to the one or more rails 1002. In the embodiment, the actuator arm 104 is slideably coupled to the housing 102 via the one or more rails 1002.

As illustrated in FIGS. 1A-2B and referring to FIGS. 7A-12, the actuator button 106 may be activated by the user to move the actuator arm 104 within the cavity 110. In some embodiments, the button 106 is shaped to accommodate a thumb or a finger of the user, to allow the user to move the actuator arm 104 with the user's thumb or finger. In an implementation, the actuator button 106 is disposed at an external end of the actuator arm 104 and is configured to be actuated by a user to move the actuator arm 104 into the second configuration (e.g., retracted configuration), to retract the locking post 108 into the housing 102.

In an embodiment, the actuator button 106 comprises a lever arranged to move the actuator arm 104 into the first configuration when the actuator button 106 (e.g., lever) is moved to a first position and to move the actuator arm 104 into the second configuration when the actuator button 106 (e.g., lever) is moved to a second position. In the embodiment, the actuator button 106 (e.g., lever) may include one or more features 1202 (as shown at FIG. 12, for example), such as a lobe, a tooth, a tab, or the like. The actuator button 106 (e.g., lever) can be arranged to rotate or pivot from the first position to the second position, and to move the actuator arm 104 from the first configuration to the second configuration, respectively, via the feature 1202 as the actuator button 106 (e.g., lever) pivots. In one example, the feature 1202 of the actuator button 106 (e.g., lever) pushes the actuator arm 104 into the housing 102 when the actuator button 106 (e.g., lever) is moved into the second position. The actuator button 106 (e.g., lever) may be returned to the first position manually, by a spring device, or other technique.

Referring again to FIGS. FIGS. 1A-2B and 7A-12, in various implementations, the locking post 108 is moveably coupled to the actuator arm 104, such that moving the actuator arm 104 moves the locking post 108. For instance, as shown at FIGS. 7A-8B, moving the actuator arm 104 in a direction into and out of the cavity 110 of the housing 102 moves the locking post 108 into and out of the housing 102. In this way, the locking post 108 can be controlled via the actuator arm 104.

As illustrated in FIGS. 1A-2B, and 7A-8B, as the actuator arm 104 travels fore and aft (i.e., along a longitudinal axis of the housing), the locking post 108 moves into the housing 102 and out of the housing 102, respectively. In other words, as the actuator arm 104 is moved in a direction out of the cavity 110 (e.g., "extended," as indicated in FIGS. 1A, 2A, and 7A-7B), the locking post 108 moves out from the housing 102 as well. As the actuator arm 104 is moved in a direction into the cavity 110 of the housing 102 (e.g., retracted, as indicated in FIGS. 1B, 2B, and 8A-8B), the locking post 108 moves into the housing 102 as well.

In alternate embodiments, the arm 104/ post 108 action may be reversed. For example, in an embodiment, extending the arm 104 from the housing 102 causes the post 108 to be retracted into the housing 102, and retracting the arm 104 into the housing 102 causes the post 108 to be extended from the housing 102. Alternately, the arm 104 may be moved in other ways (e.g., up, down, to the side, pivoted, etc.) to move the locking post 108 in and out of the housing 102 (e.g., to lock or release the implement).

Figure 11:
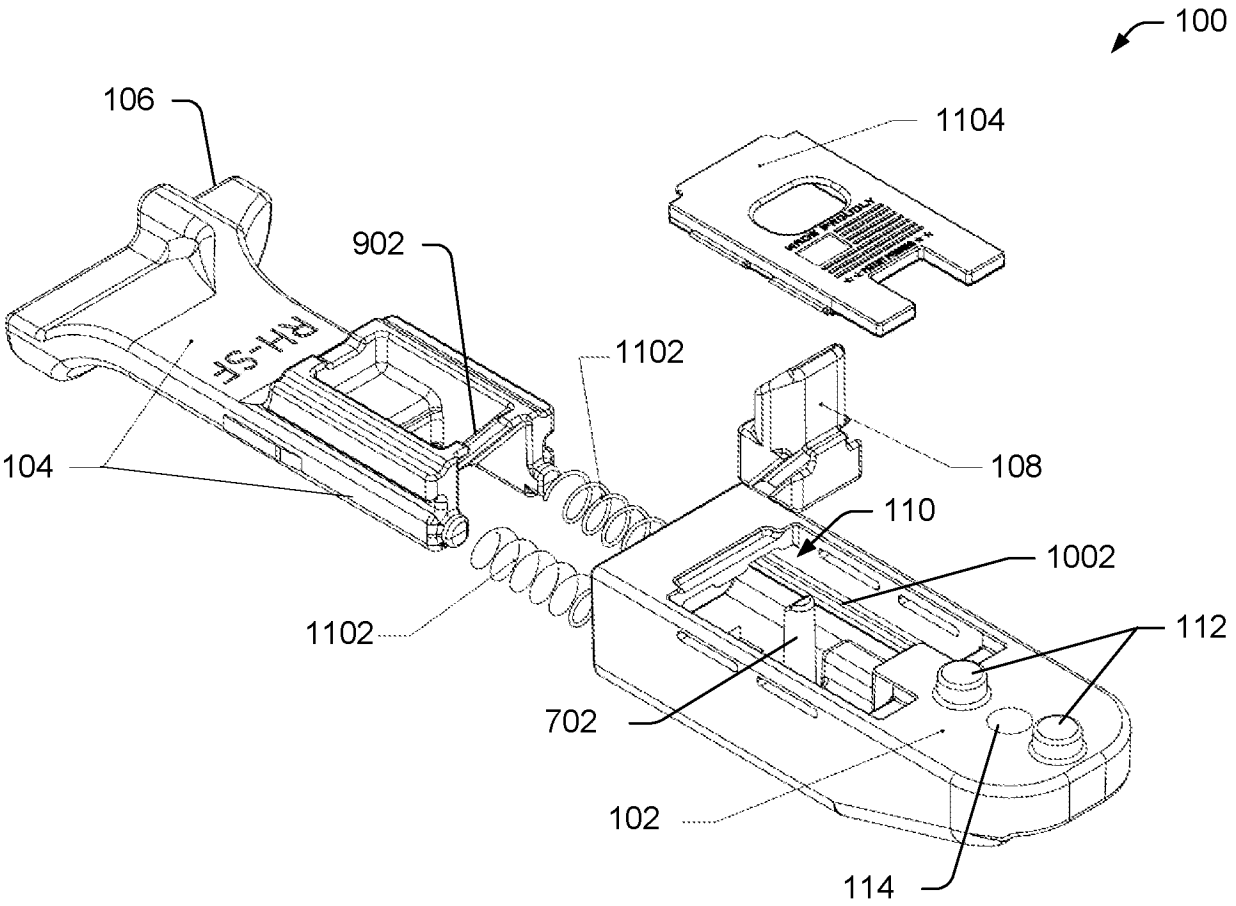
FIG. 11 is an exploded view of an example holster lock, according to an embodiment, showing component details.
Figure 12A:
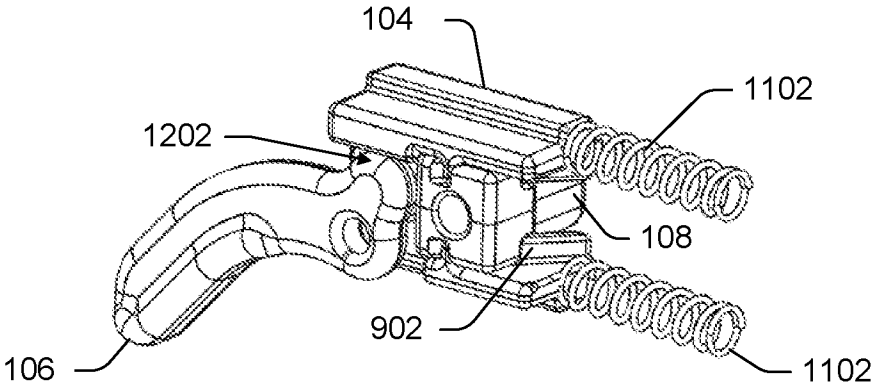
FIGS. 12A and 12B show components of an example holster lock, according to an embodiment.
Figure 12B:
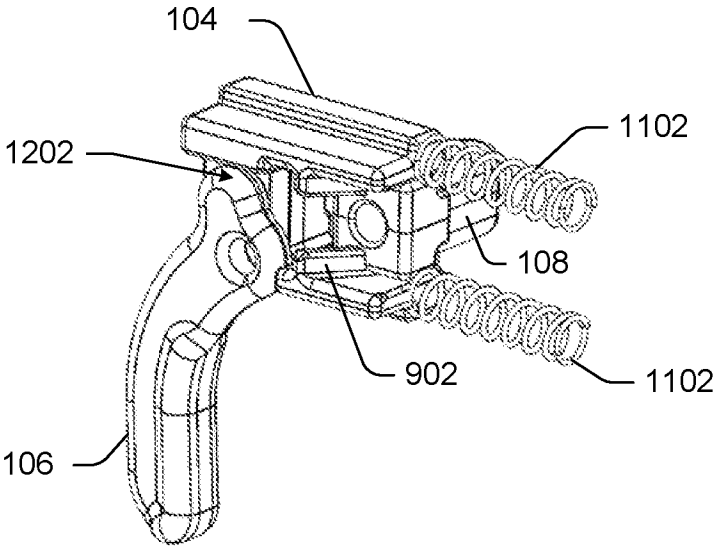

Various mechanisms may be used to move the locking post 108 via the actuator arm 104. FIGS. 11, and 12A-12B show some examples of mechanisms that may be used, according to some embodiments. For example, as shown in FIGS. 9B, 11, and 12A-12B, a ramp feature 902 (e.g., one or more ramped rails, grooves, etc.) may be coupled to (or integral to) the internal end of the actuator arm 104 (i.e., the end of the actuator arm 104 that is within the cavity 110). The locking post 108 can include one or more grooves, flanges, rails, or the like, configured to ride on the ramp feature 902. In an embodiment, the locking post 108 is slideably coupled to the actuator arm 104 via the ramp feature 902. Further, the housing 102 may include a boss 702 (or the like), arranged in a transverse (normal) orientation (or another orientation) to a longitudinal axis of the housing 102 and the actuator arm 104. The locking post 108 can include a hollow cavity (or the like) configured to ride on the boss 702. In an embodiment, the locking post 108 is slideably coupled to the housing 102 via the boss 702.

In various embodiments, the locking post 108 may ride on both the ramp 902 and the boss 702 during the movement of the actuator arm 104. For example, the locking post 108 can ride up and down on the boss 702, as the locking post 108 is extended and retracted out of and into the housing 102, and maintain its alignment relative to the housing 102 and the holster 502. Additionally, the locking post 108 can ride diagonally on the ramp 902 via grooves, flanges, rails, or the like, so that the locking post 108 is pushed out of the housing 102 or retracted into the housing 102 with the movement of the actuator arm 104. Meanwhile, the actuator arm 104 rides back and forth within the cavity 110 on the one or more rails 902 for stability.

Figures 9A, 9B:
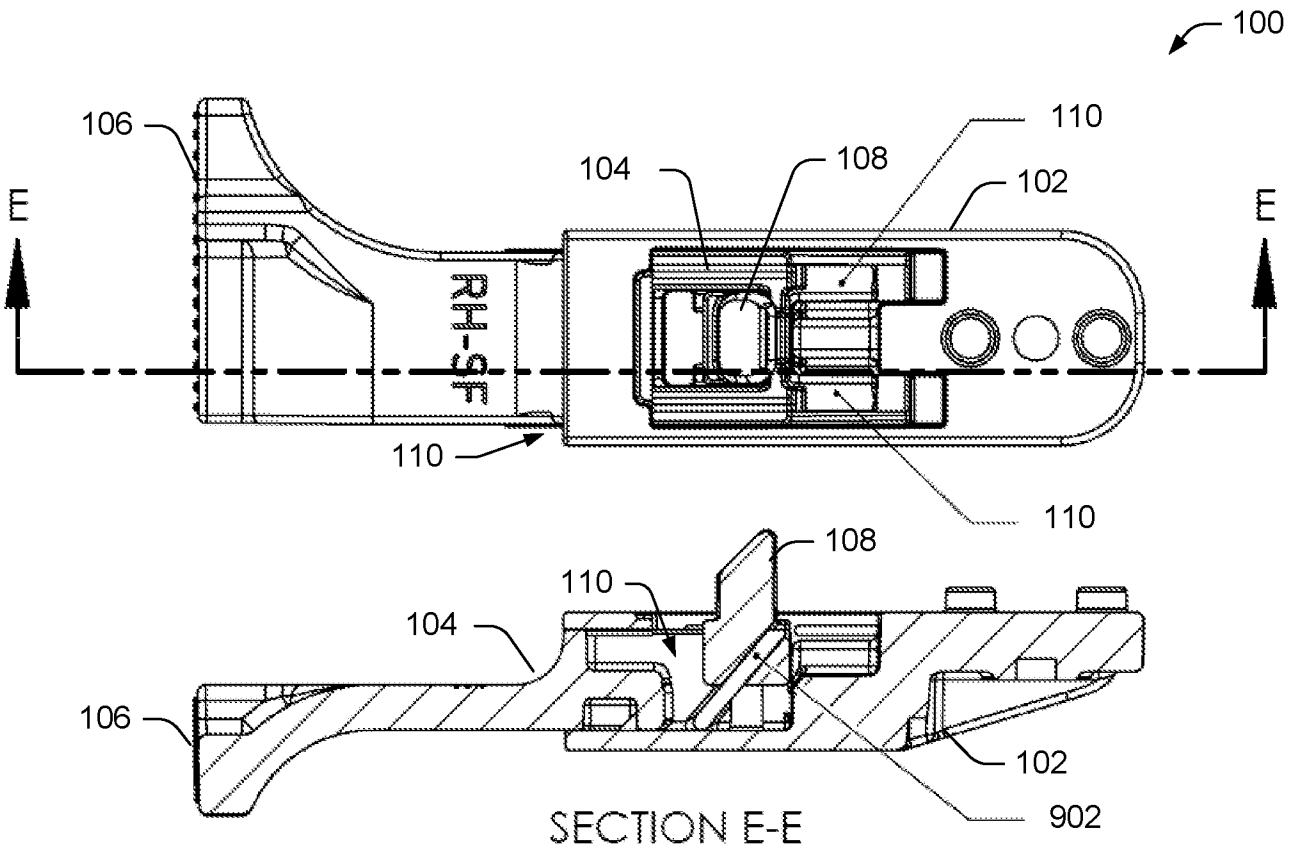
FIGS. 9A and 9B include two views of an example holster lock, according to an embodiment. Illustrated are: a bottom view at FIG. 9A and a cross-section view (shown cut-away along the section line E-E) at FIG. 9B.
Figures 10A, 10B:
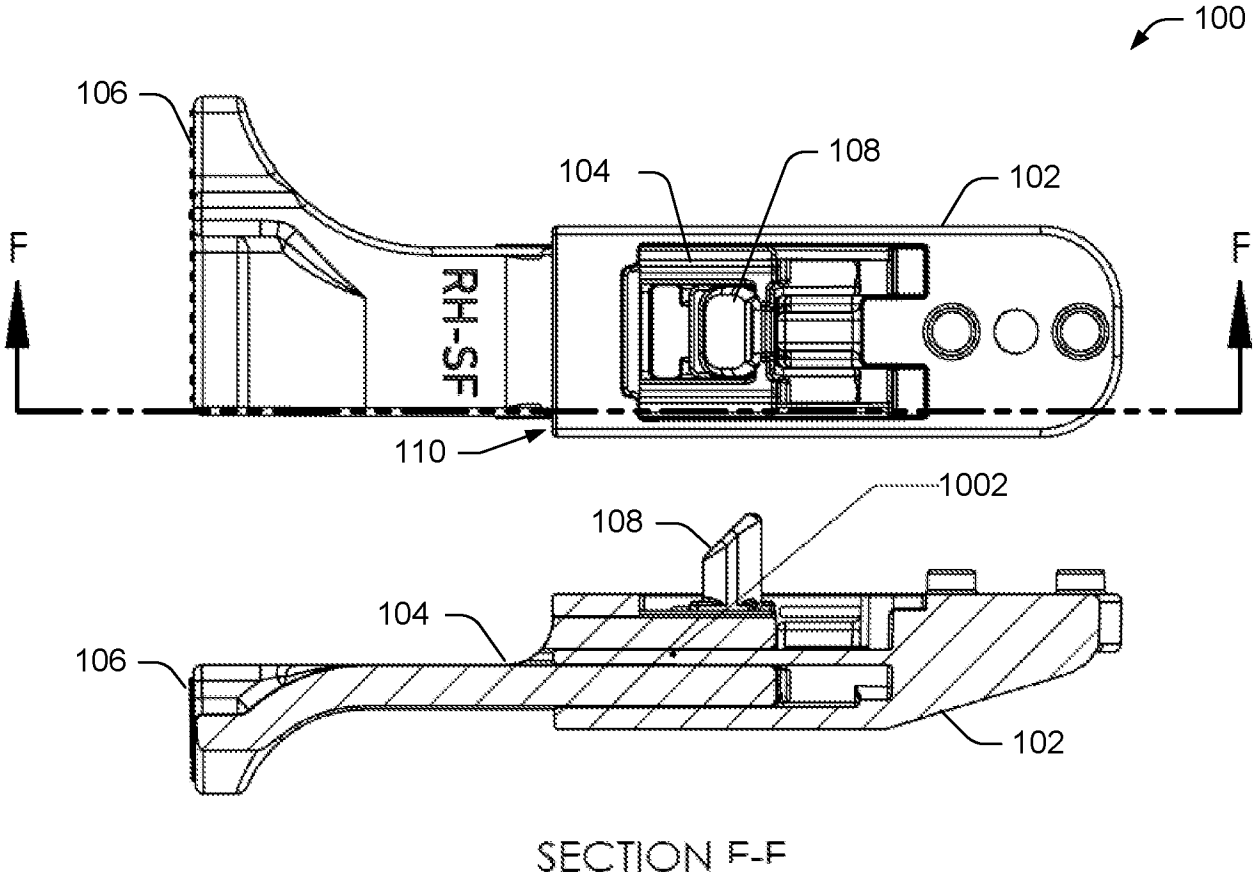
FIGS. 10A and 10B include two views of an example holster lock, according to an embodiment. Illustrated are: a bottom view at FIG. 10A and a cross-section view (shown cut-away along the section line F-F) at FIG. 10B.

In an implementation, (as shown in the example of FIG. 9B) when the actuator arm 104 is extended from the housing 102, the locking post 108 is resting on the upper end of the ramp 902, so that the locking post 108 is extended out of the housing 102. When the actuator arm 104 is retracted (pushed into the housing 102), the locking post 108 is lowered by the ramp 902 (the locking post 108 moves down on the boss 702), so that the locking post 108 is resting on the lower end of the ramp 902, and so that the locking post 108 is retracted into the housing 102.

Accordingly, in the implementation, and as shown in FIGS. 1A-2B, the locking post 108 is arranged to travel in a first direction (e.g., "90 degrees" or out of the housing 102) on the boss 702 when the actuator arm 104 travels within the cavity 110 in a second direction (e.g., "180 degrees") transverse (normal) to the first direction. As well, the locking post 108 is arranged to travel in a third direction (e.g., "270 degrees" or into the housing 102) on the boss 702 when the actuator arm 104 travels within the cavity 110 in a fourth direction (e.g., "0 degrees") normal to the third direction.

In another implementation, the ramp 902 has an alternate configuration, such that when the actuator arm 104 is extended from the housing 102, the locking post 108 is resting on the lower end of the ramp 902, so that the locking post 108 is extended out of the housing 102. When the actuator arm 104 is retracted (pushed into the housing 102), the locking post 108 is elevated by the ramp 902, so that the locking post 108 is resting on the upper end of the ramp 902, and so that the locking post 108 is retracted into the housing 102. A spring device at the top of the locking post 108, applying tension against the top of the locking post 108, can assist the locking post 108 in quickly and smoothly moving to the lower end of the ramp 902 and into the extended position when the actuator arm 104 is extended again.

In this implementation, the locking post 108 is arranged to travel in a first direction (e.g., "270 degrees" or out of the housing 102) on the boss 702 when the actuator arm 104 travels within the cavity 110 in a second direction (e.g., "180 degrees") transverse (normal) to the first direction. As well, the locking post 108 is arranged to travel in a third direction (e.g., "90 degrees" or into the housing 102) on the boss 702 when the actuator arm 104 travels within the cavity 110 in a fourth direction (e.g., "0 degrees") normal to the third direction.

In alternate embodiments, other components and techniques may be used to move the locking post 108 with the actuator arm 104. The alternate embodiments can include alternate movement directions (with regard to the actuator arm 104 and the locking post 108) than those discussed above, and remain within the scope of the disclosure.

In various embodiments, the actuator arm 104 and/or the locking post 108 are spring loaded, for example as shown in FIGS. 11 and 12A-12B. Spring devices 1102 may be used at various locations to return the actuator arm 104 and the locking post 108 to rest (to the extended state from a retracted state, for example). For instance, spring devices 1102 may be used at an internal end of the actuator arm 104, to return the actuator arm 104 to an extended state, or at an internal end of the locking post 108, to return the locking post 108 to an extended state, or both. The spring devices 1102 can also allow the implement to be inserted into the holster 502, pushing the locking post 108 into the housing 102. Once the implement clears the locking post 108 (e.g., the implement is within the holster 502), the spring device(s) 1102 return the post 108 to the extended state, automatically trapping a portion of the implement and retaining the implement within the holster 502.

While the housing 102 may be a single component in some embodiments, in others the housing 102 may be formed of multiple components. In an embodiment, the housing includes a separate bottom plate 1104. The bottom plate 1104 may be useful for assembly of the holster lock 100, and it may also include an opening for the locking post 108 to extend through.

In an implementation, one or more components of the holster lock 100, including the housing 102, the actuator arm 104, and/or the locking post 108, are partially or fully formed using an injection molding process. Accordingly, the components of the holster lock 100 can be custom molded as desired for the application and/or as needed for custom fit to a particular carrier or holster 502, for instance. In alternate implementations, one or more components of the holster lock 100) are formed by some other process (e.g., stamping, cutting, etc.).

In various implementations, components of the holster lock 100 are comprised of various plastics, composites, metals, combinations of the same, or the like. For example, the housing 102, the actuator arm 104, and/or the locking post 108 (or other components) may be comprised of a polyamide, or similar material. The use of a molded polyamide or fiber-filled polyimide provides components that are rigid and stable for reliable and repeated use, for instance. For example, some materials that may be used include nylons, aramids, styrenic block copolymers (TPE-s), polyolefin blends (TPE-o), elastomeric alloys (TPE-v or TPV), thermoplastic polyurethanes (TPU), thermoplastic co-polyesters, thermoplastic polyamides, combinations of the same, and the like.

As discussed above, the techniques, components, and devices described herein with respect to the implementations are not limited to the illustrations of FIGS. 1A-12B, and may be applied to other carrier devices and case designs without departing from the scope of the disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a holster lock 100 may be implemented as a stand-alone device or as part of another system (e.g., integrated with other components to form a locking holster 502). A holster lock 100 may be pre-combined component of a locking holster 502, or the holster lock 100 may be added to a holster 502 as an accessory, add-on, or an upgrade component.

Although various implementations and examples are discussed herein, further implementations and examples may be possible by combining the features and elements of individual implementations and examples. In various implementations, additional or alternative components may be used to accomplish the disclosed techniques and arrangements.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the disclosed techniques, systems, and devices. Further, individual features of various embodiments may be combined to form other embodiments not specifically described.

What is claimed is:

1. A lock assembly, comprising:

a housing configured to be coupled to a carrier, the housing including a cavity;

an actuator arm disposed within the cavity and free to move within the cavity along a longitudinal axis of the housing;

a locking post disposed within the housing and moveably coupled to the actuator arm, the locking post arranged to extend from the housing when the actuator arm is moved into a first configuration and to retract into the housing when the actuator arm is moved into a second configuration, the locking post configured to retain an implement within the carrier when extended from the housing; and at least one boss within the cavity arranged normal to the longitudinal axis of the housing, wherein the locking post includes a hollow cavity configured to ride on the at least one boss, the locking post being slideably coupled to the housing via the hollow cavity of the locking post and the at least one boss, and wherein the locking post is arranged to travel in a first direction on the at least one boss when the actuator arm travels within the cavity in a second direction normal to the first direction, and to travel in a third direction on the at least one boss when the actuator arm travels within the cavity in a fourth direction normal to the third direction.

2. The lock assembly of claim 1, further comprising one or more rails within the cavity arranged parallel to the longitudinal axis of the housing, the actuator arm slideably coupled to the one or more rails.

3. The lock assembly of claim 1, further comprising one or more ramped rails disposed at an internal end of the actuator arm.

4. The lock assembly of claim 3, wherein the locking post is slideably coupled to the one or more ramped rails.

5. The lock assembly of claim 1, further comprising an actuator button disposed at an external end of the actuator arm and configured to be actuated by a user to move the actuator arm into the second configuration and to retract the locking post within the housing.

6. The lock assembly of claim 5, wherein the actuator button comprises a lever arranged to move the actuator arm into the first configuration when the lever is moved to a first position and to move the actuator arm into the second configuration when the lever is moved to a second position.

7. The lock assembly of claim 1, further comprising a mounting portion integral to or coupled to the housing, the mounting portion configured to temporarily or permanently couple the lock assembly to an implement holster.

8. The lock assembly of claim 7, wherein the locking post is configured to engage and to trap a portion of an implement, to retain the implement within the implement holster, when the locking post is extended from the housing, and to release the portion of the implement, to allow the implement to be withdrawn from the implement holster, when the locking post is retracted into the housing.

9. The lock assembly of claim 1, further comprising one or more spring components arranged to return the actuator arm, the locking post, or the actuator arm and the locking post to an extended state from a retracted state.

10. The lock assembly of claim 9, wherein the one or more spring components are configured to allow the locking post to be retracted into the housing while an implement is being inserted into the carrier and to return the locking post to the extended state, trapping a portion of the implement, after the implement is inserted into the carrier.

11. The lock assembly of claim 1, wherein the locking post is arranged to extend from the housing when the actuator arm extends from the housing and to retract into the housing when the actuator arm retracts into the housing.

12. The lock assembly of claim 1, wherein the locking post is arranged to extend through an opening of the carrier and into an interior of the carrier when the lock assembly is coupled to the carrier and the actuator arm is moved into the first configuration.

13. A holster lock assembly, comprising:

a housing configured to be coupled to a firearm holster, the housing including a cavity within the housing;

an actuator arm disposed within the cavity and slideably coupled to one or more rails within the cavity, the rails disposed parallel to a longitudinal axis of the housing; and a locking post disposed within the housing and slideably coupled to a boss within the cavity, the boss disposed normal to the longitudinal axis of the housing, wherein the locking post includes a hollow cavity configured to ride on the boss, the locking post being slideably coupled to the housing via the hollow cavity of the locking post and the boss, wherein the locking post is arranged to travel in a first direction on the boss when the actuator arm travels within the cavity in a second direction normal to the first direction, and to travel in a third direction on the boss when the actuator arm travels within the cavity in a fourth direction normal to the third direction, the locking post arranged to extend from the housing when the actuator arm moves away from the locking post and to retract into the housing when the actuator arm moves toward the locking post.

14. The holster lock assembly of claim 13, wherein the locking post is arranged to engage and to trap a portion of a firearm, to retain the firearm within the firearm holster, while the actuator arm is extended from the housing.

15. The holster lock assembly of claim 13, wherein the locking post is arranged to release a hold on a firearm stored within the firearm holster, to allow the firearm to be withdrawn from the firearm holster, while the actuator arm is retracted into the housing.

16. A locking holster, comprising:

an implement holster adapted to receive and to carry an implement, the holster including a pocket arranged to carry the implement and an opening in a surface of the holster; and a lock assembly coupled to the holster, the lock assembly including:

a housing, including a cavity;

an actuator arm disposed within the cavity and free to move within the cavity along a longitudinal axis of the housing; and a locking post disposed within the housing and slideably coupled to a boss within the housing, the boss disposed normal to the longitudinal axis of the housing, wherein the locking post includes a hollow cavity configured to ride on the boss, the locking post being slideably coupled to the housing via the hollow cavity of the locking post and the boss, wherein the locking post is arranged to travel in a first direction on the boss when the actuator arm travels within the cavity in a second direction normal to the first direction, and to travel in a third direction on the boss when the actuator arm travels within the cavity in a fourth direction normal to the third direction, wherein the locking post is arranged to extend from the housing and into the pocket, through the opening in the surface of the holster, when the actuator arm is activated in a first configuration and to retract into the housing and out of the pocket when the actuator arm is activated in a second configuration.

17. The locking holster of claim 16, wherein the locking post is configured to trap a portion of the implement and to retain the implement within the holster when the locking post is extended from the housing.

18. The locking holster of claim 16, wherein the locking post is slideably coupled to the actuator arm, and wherein the locking post is arranged to release a hold on an implement stored within the implement holster, to allow the implement to be withdrawn from the implement holster, when the actuator arm is retracted into the housing.

* * * * *